US009770092B2

(12) United States Patent
Tseng et al.

(10) Patent No.: US 9,770,092 B2
(45) Date of Patent: Sep. 26, 2017

(54) BRUSH, BACK SURFACE TREATMENT ASSEMBLY AND METHOD FOR CLEANING SUBSTRATE

(71) Applicant: TAIWAN SEMICONDUCTOR MANUFACTURING CO., LTD., Hsinchu (TW)

(72) Inventors: Kuo-Shu Tseng, New Taipei (TW); Yao-Yuan Shang, Taichung (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 0 days.

(21) Appl. No.: 14/831,502

(22) Filed: Aug. 20, 2015

(65) Prior Publication Data

US 2017/0049221 A1 Feb. 23, 2017

(51) Int. Cl.

| | |
|---|---|
| ***A46B 13/08*** | (2006.01) |
| ***A46B 13/02*** | (2006.01) |
| ***A46B 13/00*** | (2006.01) |

(52) U.S. Cl.

CPC ..... *A46B 13/02* (2013.01); *A46B 13/008* (2013.01)

(58) Field of Classification Search

CPC ..... B08B 1/002; B08B 1/04; H01L 21/304; H01L 21/67046; B24B 37/04; A46B 13/02; A46B 13/008

See application file for complete search history.

(56) References Cited

U.S. PATENT DOCUMENTS

| | | | | |
|---|---|---|---|---|
| 6,110,832 | A * | 8/2000 | Morgan, III | B24B 37/26 156/345.12 |
| 6,158,075 | A * | 12/2000 | Tanaka | B08B 1/007 134/6 |
| 7,018,274 | B2 * | 3/2006 | Muldowney | B24B 37/26 451/282 |
| 9,180,570 | B2 * | 11/2015 | Kerprich | B24B 37/26 |
| 2013/0206171 | A1 * | 8/2013 | Kurusu | H01L 21/304 134/6 |

* cited by examiner

*Primary Examiner* — Shay Karls
(74) *Attorney, Agent, or Firm* — Maschoff Brennan

(57) ABSTRACT

A brush for back surface treatment (BST) is provided. The brush includes a base portion and a brushing portion. The brushing portion is connected to the base portion. The brushing portion has a plurality of gutters disposed on a surface away from the base portion, in which at least one of the gutters has at least one open end located at least partially on a perimeter of the surface.

20 Claims, 4 Drawing Sheets

BRUSH, BACK SURFACE TREATMENT ASSEMBLY AND METHOD FOR CLEANING SUBSTRATE

BACKGROUND

The present disclosure generally relates to brushes, and specifically relates to brushes for back surface treatment (BST).

Back surface treatment is generally a module process to prepare the back surface of a substrate before the next module process of scanning. In general, a brush is utilized to rub and clean the back surface of the substrate in order to remove particles unexpectedly stuck thereon.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
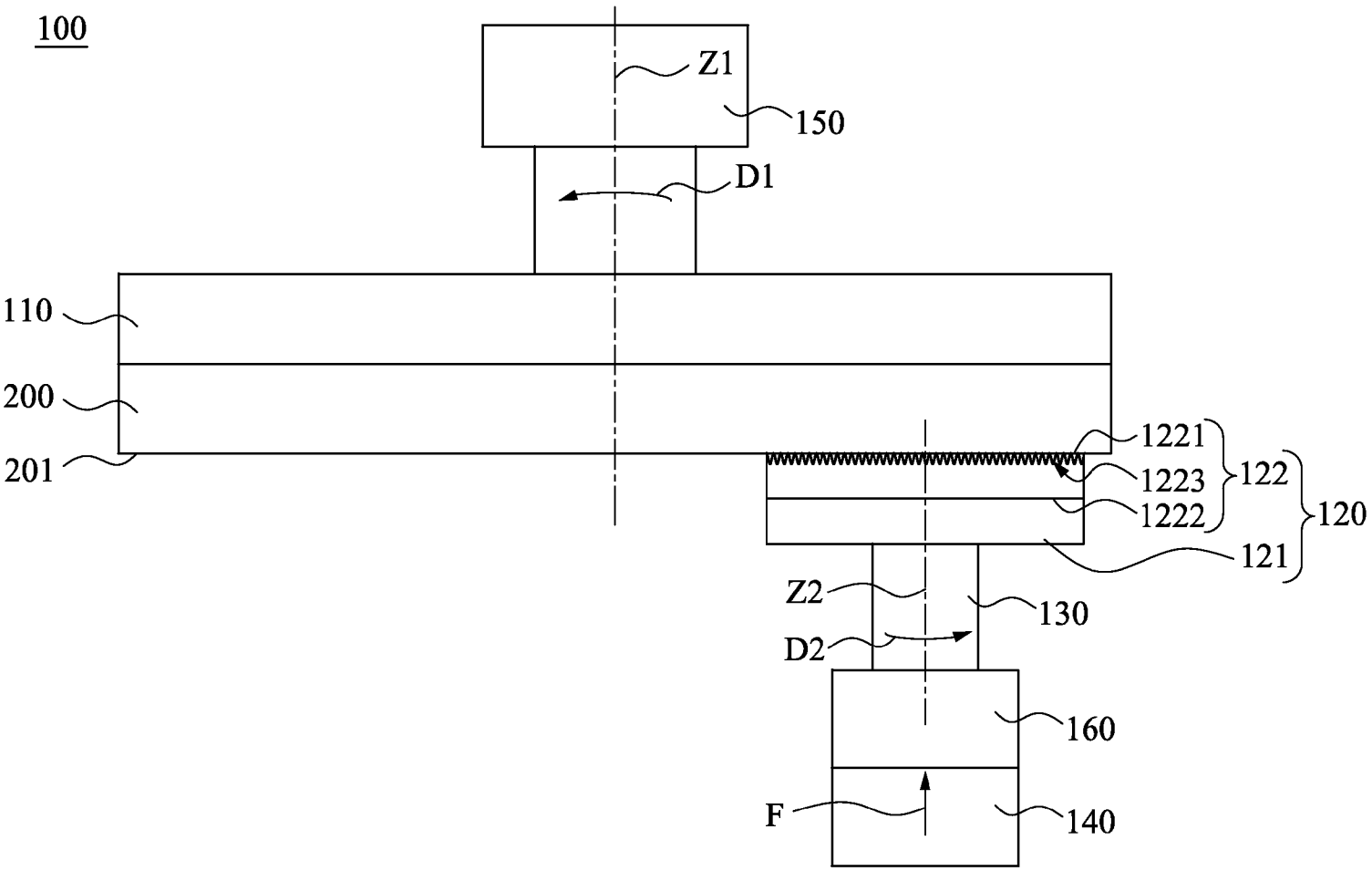
FIG. 1 is a front view of a back surface treatment (BST) assembly in accordance with some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, operations, operations, elements, and/or components, but do not preclude the presence or addition of one or more other features, regions, integers, operations, operations, elements, components, and/or groups thereof.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 2:
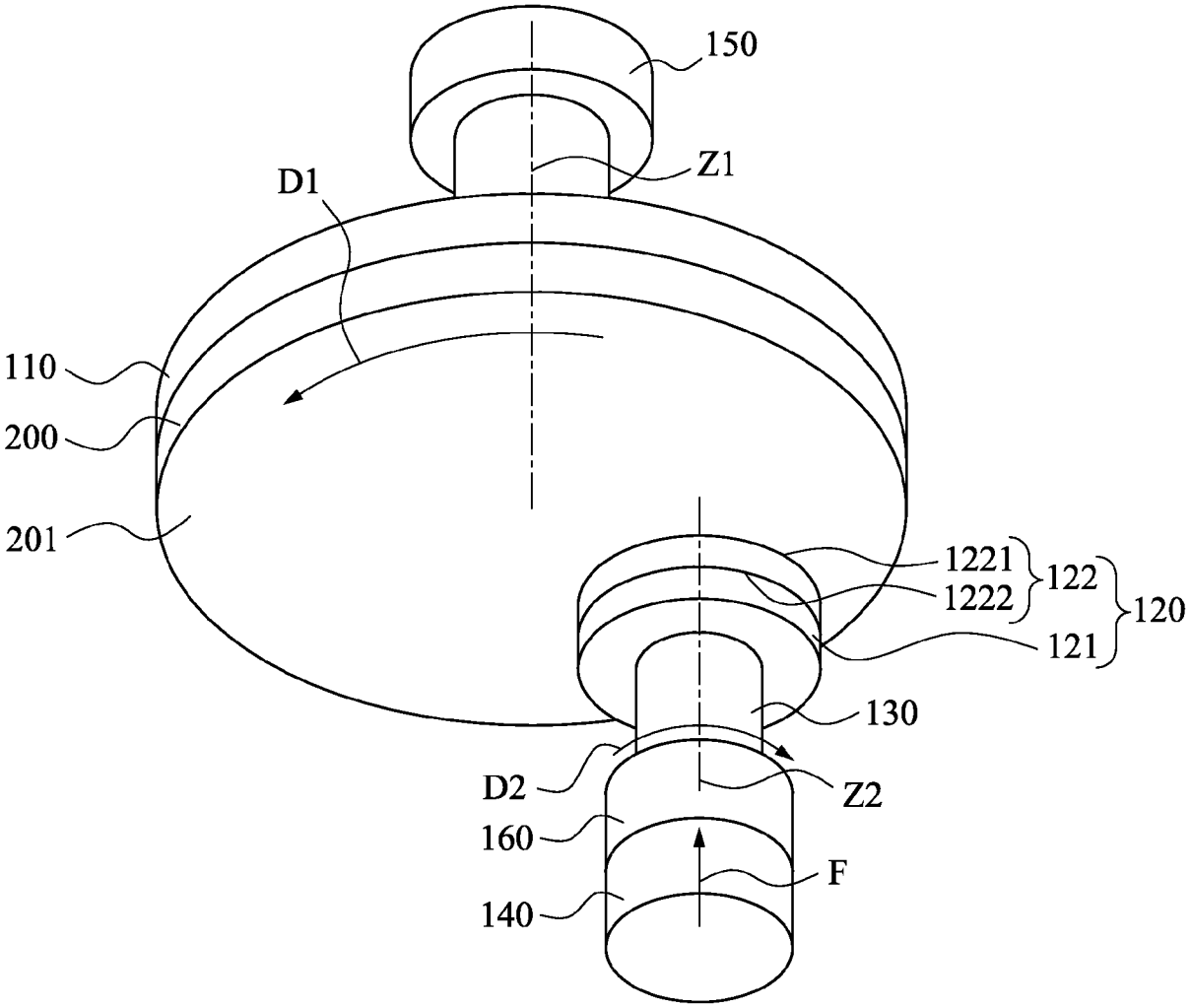
FIG. 2 is a bottom perspective view of the back surface treatment assembly of FIG. 1.

Reference is made to FIGS. 1 and 2. FIG. 1 is a front view of a back surface treatment (BST) assembly 100 in accordance with some embodiments of the present disclosure. FIG. 2 is a bottom perspective view of the back surface treatment assembly 100 of FIG. 1. As shown in FIGS. 1 and 2, the back surface treatment assembly 100 includes a carrier head 110, a brush 120 and a brush holder 130. The carrier head 110 is configured for holding a substrate 200. The brush 120 includes a base portion 121 and a brushing portion 122. The brushing portion 122 has a first surface 1221 and a second surface 1222 opposite to each other. The first surface 1221 is configured for contacting with the substrate 200. The second surface 1222 is connected to the base portion 121. The brushing portion 122 has a plurality of gutters 1223 disposed on the first surface 1221. The brush holder 130 is configured for holding the base portion 121. In some embodiments, the substrate 200 can be a wafer. However, this does not intend to limit the present disclosure.

In practical applications, the back surface 201 of the substrate 200 is pre-cleaned for some processing procedures. The back surface 201 of the substrate 200 is the side of the substrate 200 away from the carrier head 110 and is to be contacted by the first surface 1221 of the brushing portion 122. Before the progress of one or more processing procedures, the back surface 201 of the substrate 200 is to be cleaned first by the operation of the back surface treatment assembly 100.

Before the back surface treatment assembly 100 operates, the substrate 200 is first positioned and held by the carrier head 110, with the back surface 201 of the substrate 200 facing away from the carrier head 110. On the other hand, the base portion 121 of the brush 120 is positioned and held by the brush holder 130, with the brushing portion 122 of the brush 120 contacting with the back surface 201 of the substrate 200. To be more specific, the first surface 1221 of the brushing portion 122 contacts with the back surface 201 of the substrate 200.

Furthermore, the back surface treatment assembly 100 further includes at least one rotating mechanism. The rotating mechanism is configured for rotating at least one of the carrier head 110 and the brush holder 130. In some embodiments, to be more specific, the back surface treatment assembly 100 further includes a carrier head rotating mechanism 150. The carrier head rotating mechanism 150 is configured for rotating the carrier head 110. On the other hand, the back surface treatment assembly 100 further includes a brush holder rotating mechanism 160. The brush holder rotating mechanism 160 is configured for rotating the brush holder 130. When the back surface treatment assembly 100 operates, the carrier head rotating mechanism 150 rotates the carrier head 110 together with the substrate 200 in a first direction D1 while the brush holder rotating mechanism 160 rotates the brush holder 130 together with the base portion 121 of the brush 120 in a second direction D2. The second direction D2 is opposite to the first direction D1. In this way, the first surface 1221 of the brushing portion 122 rubs against the back surface 201 of the substrate 200 and removes the particles on the back surface 201 of the substrate 200.

In practical applications, for instance, when the carrier head rotating mechanism 150 rotates the carrier head 110 together with the substrate 200 in a clockwise direction (the first direction D1), the brush holder rotating mechanism 160 rotates the brush holder 130 together with the base portion 121 of the brush 120 in an anti-clockwise direction (the second direction D2). On the contrary, when the carrier head rotating mechanism 150 rotates the carrier head 110 together with the substrate 200 in an anti-clockwise direction (the first direction D1), the brush holder rotating mechanism 160 rotates the brush holder 130 together with the base portion 121 of the brush 120 in a clockwise direction (the second direction D2) instead.

In addition, the carrier head rotating mechanism 150 is configured for rotating the carrier head 110 about a first axis Z1 while the brush holder rotating mechanism 160 is configured for rotating the brush holder 130 about a second axis Z2. In some embodiments, the second axis Z2 is substantially parallel with the first axis Z1. However, this does not intend to limit the present disclosure.

To be more specific, when the first surface 1221 of the brushing portion 122 rubs against the back surface 201 of the substrate 200 as mentioned above, the particles on the back surface 201 of the substrate 200 are removed and guided to the gutters 1223 of the brush 120. After the particles are guided to the gutters 1223, due to the rotation of the brush 120, the particles are forced to move along the gutters 1223. In some embodiments, the particles can be dust or substances that unexpectedly stuck on the back surface 201 of the substrate 200. In practice, the size of the particles may be in the order of nanometers.

Figure 3:
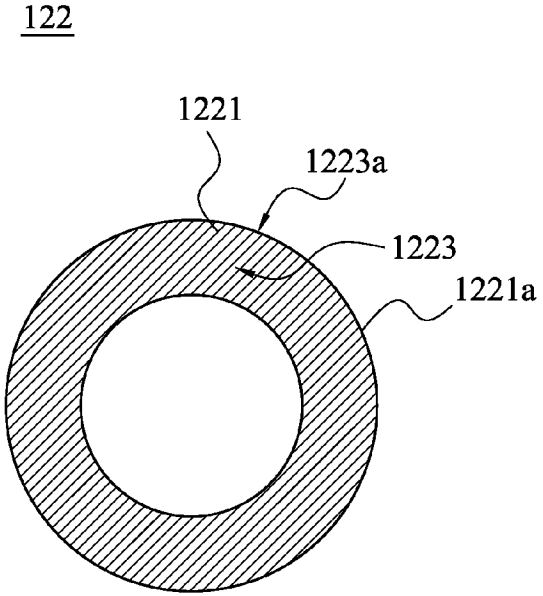
FIG. 3 is a top view of the brush of FIG. 1.

Reference is made to FIG. 3. FIG. 3 is a top view of the brush 120 of FIG. 1. Technically speaking, at least one of the gutters 1223 has at least one open end 1223*a* located at least partially on a perimeter 1221*a* of the first surface 1221 of the brushing portion 122. As shown in FIG. 3, at least one of the gutters 1223 is in a shape of a strip. To be more specific, there is at least one open end 1223*a* located at the end of at least one gutter 1223 along the perimeter 1221*a* of the first surface 1221 of the brushing portion 122. When the particles guided to the gutters 1223 are forced to move along the gutters 1223 due to the rotation of the brush 120, the particles are correspondingly moved to the open ends 1223*a*. Consequently, since the open ends 1223*a* are open and communicated to the space surrounding the brushing portion 122, the particles guided to the gutters 1223 are forced to move out of the brush 120 through the open ends 1223*a* of the gutters 1223 due to the rotation of the brush 120. As a result, after the back surface 201 of the substrate 200 is rubbed and cleaned by the brush 120, few or no particle is remained in the brush 120. Thus, the brush 120 is kept clean and can be properly used again for the next operation. Therefore, the service life of the brush 120 is increased and thus the cost for cleaning the substrate 200 is accordingly decreased.

In order to further enhance the cleaning effect of the back surface 201 of the substrate 200, the back surface treatment assembly 100 further includes a compression force exerting mechanism 140. The compression force exerting mechanism 140 is configured for exerting a compression force F to the brush 120 against the substrate 200. During the operation of the back surface treatment assembly 100, as shown in FIGS. 1 and 2, the compression force exerting mechanism 140 exerts the compression force F to the brush 120 through the brush holder 130, or directly to the brush 120 in other embodiments. The brushing portion 122 of the brush 120 then transmits the compression force F to the back surface 201 of the substrate 200. Therefore, when the first surface 1221 of the brushing portion 122 rubs against the back surface 201 of the substrate 200 during the operation of the back surface treatment assembly 100, the compression force F increases the resultant force by the brush 120 acting on the particles stuck on the back surface 201 of the substrate 200. In this way, the particles become easier to be detached and removed from the back surface 201 of the substrate 200. In some embodiments, the compression force F acting on the back surface 201 of the substrate 200 by the brush 120 ranges from about 0.5 N to about 5.0 N. However, this does not intend to limit the present disclosure.

In general, since the area of the first surface 1221 of the brushing portion 122 is smaller than the area of the back surface 201 of the substrate 200, the brush holder 130 is movable relative to the substrate 200 while the first surface 1221 of the brushing portion 122 and the back surface 201 of the substrate 200 are kept in contact. This means a distance between the first axis Z1 and the second axis Z2 is adjustable. When the brush 120 is to rub against and clean the region near the center of the back surface 201 of the substrate 200, the second axis Z2 moves close to the first axis Z1. On the other hand, when the brush 120 is to rub against and clean the region near the edge of the back surface 201 of the substrate 200, the second axis Z2 moves away from the first axis Z1. In this way, during the operation of the back surface treatment assembly 100, the first surface 1221 of the brushing portion 122 is able to rub against different regions of the back surface 201 of the substrate 200 by the movement of the brush 120 relative to the substrate 200. As a result, the whole area of the back surface 201 of the substrate 200 can be cleaned and the particles stuck on different regions of the back surface 201 of the substrate 200 can be detached and removed.

Figure 4:
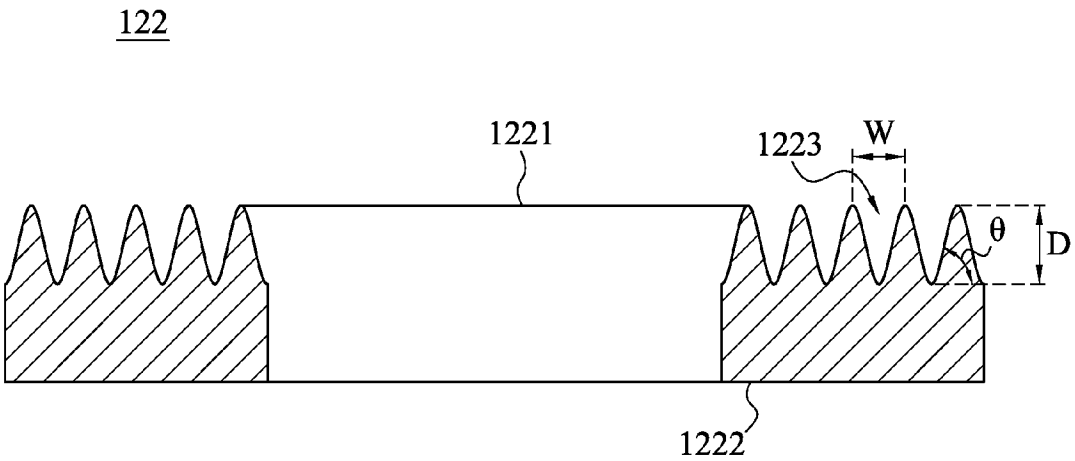
FIG. 4 is a magnified sectional view of the brushing portion of FIG. 1.

Reference is made to FIG. 4. FIG. 4 is a magnified sectional view of the brushing portion 122 of FIG. 1. As shown in FIG. 4, the brushing portion 122 of the brush 120 (not shown in FIG. 4) has the gutters 1223 disposed on the first surface 1221. The depth D of at least one gutter 1223 and the angle θ of the inner wall of at least one gutter 1223 together define the width W of at least one gutter 1223. In some embodiments, with respect to the size of the particles stuck on the back surface 201 of the substrate 200, the depth D of the gutter 1223 ranges from about 0.01 mm to about 1 mm while the angle θ of the inner wall of the gutter 1223 ranges from about 10 degrees to about 90 degrees. Consequently, the width W of gutter 1223 ranges from about 0.01 mm to about 1 mm accordingly. However, these dimensions do not intend to limit the present disclosure.

Originally before the brushing portion 122 of the brush 120 contacts with the back surface 201 of the substrate 200, as shown in FIG. 4, the shape of at least one of the structures of the brushing portion 122 between the gutters 1223 is roughly of a triangular shape. During the operation of the back surface treatment assembly 100, as mentioned above, the compression force exerting mechanism 140 exerts the compression force F to the brush 120 through the brush holder 130. Consequently, the brushing portion 122 of the brush 120 contacts with the back surface 201 of the substrate 200 and transmits the compression force F to the back surface 201 of the substrate 200. At this point, the triangular shaped structures of the brushing portion 122 between the gutters 1223 are deformed upon the contact with the back surface 201 of the substrate 200 due to the compression force F and become roughly trapezoidal in shape.

Figure 5:
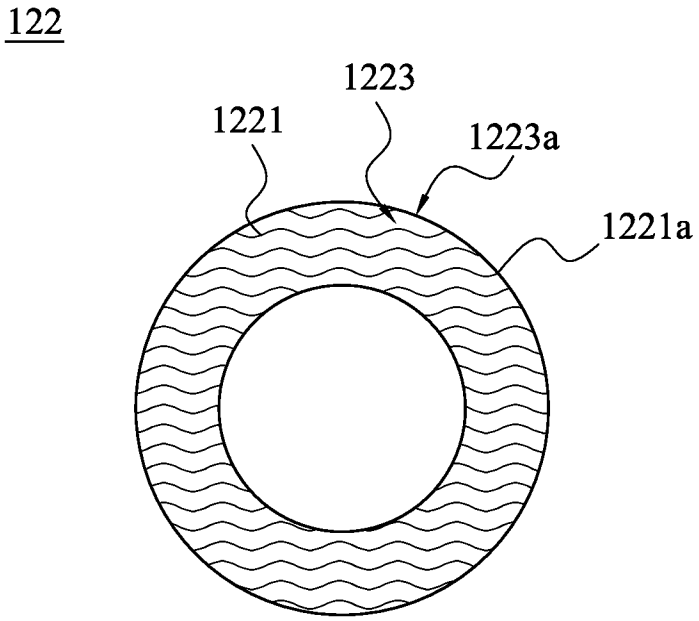
FIG. 5 is a top view of a brush in accordance with some other embodiments of the present disclosure.

Reference is made to FIG. 5. FIG. 5 is a top view of a brush 120 in accordance with some other embodiments of the present disclosure. As shown in FIG. 5, at least one of the gutters 1223 is in a shape of a wave. To be more specific, there is at least one open end 1223*a* located at the end of at least one gutter 1223 along the perimeter 1221*a* of the first surface 1221 of the brushing portion 122. As a result, particles guided to the gutters 1223 can be forced to move out of the brush 120 through the open ends 1223*a* of the gutters 1223 due to the rotation of the brush 120. Similarly, after the back surface 201 of the substrate 200 is rubbed and cleaned by the brush 120, few or no particle is remained in the brush 120. Thus, the brush 120 is kept clean and can be properly used again for the next operation. Therefore, the service life of the brush 120 is increased and thus the cost for cleaning the substrate 200 is accordingly decreased.

Figure 6:
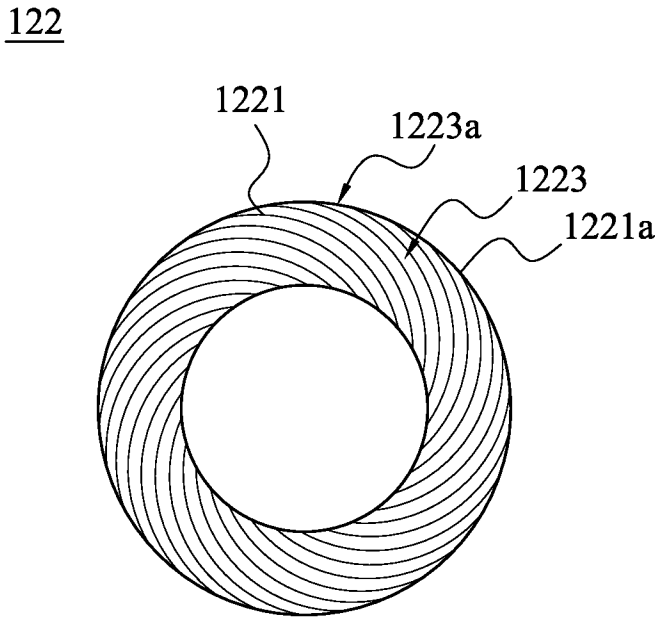
FIG. 6 is a top view of a brush in accordance with some further embodiments of the present disclosure.

Reference is made to FIG. 6. FIG. 6 is a top view of a brush 120 in accordance with some further embodiments of the present disclosure. As shown in FIG. 6, at least one of the gutters 1233 is in a shape of a spiral. To be more specific, similarly, there is at least one open end 1223*a* located at the end of at least one gutter 1223 along the perimeter 1221*a* of the first surface 1221 of the brushing portion 122. As a result, particles guided to the gutters 1223 can be forced to move out of the brush 120 through the open ends 1223*a* of the gutters 1223 due to the rotation of the brush 120. Similarly, after the back surface 201 of the substrate 200 is rubbed and cleaned by the brush 120, few or no particle is remained in the brush 120. Thus, the brush 120 is kept clean and can be properly used again for the next operation. Therefore, the service life of the brush 120 is increased and thus the cost for cleaning the substrate 200 is accordingly decreased.

In practical applications, the brushing portion 122 of the brush 120 includes a material of polyvinyl alcohol. Polyvinyl alcohol can be abbreviated as PVOH, PVA or PVAI. Basically, polyvinyl alcohol is a synthetic polymer being good in water resistance. Since polyvinyl alcohol is non-toxic, it is safe to be handled. In addition, since the melting point of polyvinyl alcohol is 220° C., the heat produced during the rubbing of the first surface 1221 of the brushing portion 122 against the back surface 201 of the substrate 200 is not able to melt the brushing portion 122 (polyvinyl alcohol) of the brush 120. Furthermore, the boiling point of polyvinyl alcohol is 228° C. and the flash point of polyvinyl alcohol is 79.44° C. In some embodiments, the thickness (the distance between the first surface 1221 and the second surface 1222) of the brushing portion 122 ranges from about 0.5 cm to about 2.0 cm. However, this does not intend to limit the present disclosure.

On the other hand, the base portion 121 of the brush 120 includes a plastic material and the thickness of the base portion 121 ranges from about 0.5 cm to about 2.0 cm in practice. However, this does not intend to limit the present disclosure.

With reference to the back surface treatment 100 as mentioned above, the embodiments of the present disclosure further provide a method for cleaning the substrate 200. The method includes the following steps (it is appreciated that the sequence of the steps and the sub-steps as mentioned below, unless otherwise specified, all can be adjusted according to the actual needs, or even executed at the same time or partially at the same time):

(1) contacting the first surface 1221 of the brush 120 to the substrate 200, such that the first surface 1221 of the brushing portion 122 contacts with the back surface 201 of the substrate 200, in which the brush 120 has the gutters 1223 on the first surface 1221 of the brush 120; and (2) rotating at least one of the brush 120 and the substrate 200 to brush the substrate 200, in a way that the first surface 1221 of the brushing portion 122 and the back surface 201 of the substrate 200 rub against each other, such that the particles are removed from the substrate 200 through the gutters 1223 of the brush 120.

In this way, few or no particle is remained in the brush 120 after the cleaning process by the back surface treatment assembly 100. Thus, the brush 120 is kept clean after the back surface 201 of the substrate 200 is rubbed and cleaned and the brush 120 can be properly used again for the next operation. As a result, the service life of the brush 120 is increased and thus the cost for cleaning the back surface 201 of the substrate 200 is accordingly decreased.

Technically speaking, as mentioned above, at least one of the gutters 1223 has at least one open end 1223*a* located at least partially on a perimeter 1221*a* of the first surface 1221 of the brushing portion 122. When the brush 120 rotates, the particles guided to the gutters 1223 are forced to move along the gutters 1223. Consequently, the particles are correspondingly moved to the open ends 1223*a* of the gutters 1223. In order to facilitate the removal of particles away from the brush 120 through the gutters 1223 of the brush 120, the step of rotating includes:

(2.1) moving the particles away from the brush 120 at least through the one open end 1223*a* of said at least one of the gutters 1223.

Furthermore, for the sake of a more effective rubbing effect on the back surface 201 of the substrate 200, the step of rotating includes:

(2.2) rotating the substrate 200 in the first direction D1; and (2.3) rotating the brush 120 in the second direction D2 opposite to the first direction D1.

In addition, the substrate 200 is rotated about the first axis Z1 in the first direction D1 while the brush 120 is rotated about the second axis Z2 in the second direction D2. In some embodiments, the second axis Z2 is substantially parallel with the first axis Z1. However, this does not intend to limit the present disclosure.

In order to clean the whole area of the back surface 201 of the substrate 200 and effectively remove the particles stuck on different regions of the back surface 201 of the substrate 200, the method for cleaning the substrate 200 further includes:

(3) moving the brush 120 relative to the substrate 200, with the first surface 1221 of the brushing portion 122 and the back surface 201 of the substrate 200 kept in contact, such that the first surface 1221 of the brushing portion 122 is able to rub against different regions of the back surface 201 of the substrate 200.

In order to further enhance the cleaning effect of the back surface 201 of the substrate 200, the method for cleaning the substrate 200 further includes:

(4) exerting a compression force F to the brush 120 against the substrate 200, which increases the resultant force by the brush 120 acting on the particles stuck on the back surface 201 of the substrate 200. In this way, the particles become easier to be detached and removed from the back surface 201 of the substrate 200. In some embodiment, the compression force F acting on the back surface 201 of the substrate 200 by the brush 120 ranges from about 0.5 N to about 5.0 N. However, this does not intend to limit the present disclosure.

According to various embodiments of the present disclosure, the brushing portion 122 has the gutters 1223 disposed on the first surface 1221 of the brushing portion 122. In addition, at least one of the gutters 1223 has at least one open end 1223*a* located at least partially on a perimeter 1221*a* of the first surface 1221 of the brushing portion 122. When the first surface 1221 of the brushing portion 122 rubs against the back surface 201 of the substrate 200, the particles on the back surface 201 of the substrate 200 are removed and guided to the gutters 1223 of the brush 120. After the particles are guided to the gutters 1223, due to the rotation of the brush 120, the particles are forced to move along the gutters 1223 and are correspondingly moved to the open ends 1223. Consequently, since the open ends 1223*a* are open and communicated to the space surrounding the brushing portion 122, the particles guided to the gutters 1223 are forced to move out of the brush 120 through the open ends 1223*a* of the gutters 1223 due to the rotation of the brush 120. As a result, after the back surface 201 of the substrate 200 is rubbed and cleaned by the brush 120, few or no particle is remained in the brush 120. Thus, the brush 120 is kept clean and can be properly used again for the next operation. Therefore, the service life of the brush 120 is increased and thus the cost for cleaning the substrate 200 is accordingly decreased.

According to various embodiments of the present disclosure, the brush for back surface treatment (BST) is provided. The brush includes the base portion and the brushing portion. The brushing portion is connected to the base portion. The brushing portion has the gutters disposed on the surface away from the base portion, in which at least one of the gutters has at least one open end located at least partially on the perimeter of the surface.

According to various embodiments of the present disclosure, the back surface treatment (BST) assembly includes the carrier head, the brush and the brush holder. The carrier head is configured for holding the substrate. The brush includes the base portion and the brushing portion. The brushing portion has the first surface and the second surface opposite to each other. The first surface is configured for contacting with the substrate. The second surface is connected to the base portion. The brushing portion has the gutters disposed on the first surface. The brush holder is configured for holding the base portion.

According to various embodiments of the present disclosure, the method for cleaning the substrate is provided. The method includes contacting the surface of the brush to the substrate, in which the brush has gutters on the surface of the brush, and rotating at least one of the brush and the substrate to brush the substrate, such that the particles are removed from the substrate through the gutters.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A brush for back surface treatment (BST), the brush comprising:

a base portion; and a brushing portion connected to the base portion, the brushing portion having a plurality of discrete gutters disposed on a surface away from the base portion, wherein at least one of the discrete gutters has two opposite open ends located on a perimeter of the surface, and a sidewall of at least one of the discrete gutters is inclined at an angle relative to the surface.

2. The brush of claim 1, wherein at least one of the discrete gutters is in a shape of a strip.

3. The brush of claim 1, wherein at least one of the discrete gutters is in a shape of a wave.

4. The brush of claim 1, wherein the brushing portion comprises a material of polyvinyl alcohol.

5. The brush of claim 1, wherein the base portion comprises a plastic material.

6. The brush of claim 1, wherein at least one of the discrete gutters has a depth measured from the surface.

7. The brush of claim 6, wherein the depth ranges substantially from about 0.01 mm to about 1 mm.

8. The brush of claim 1, wherein the angle ranges substantially from about 10 degrees to about 90 degrees.

9. A back surface treatment (BST) assembly, comprising:

a carrier head configured for holding a substrate;

a brush, comprising:

a base portion; and a brushing portion having a first surface and a second surface opposite to each other, the first surface configured for contacting with the substrate, the second surface being connected to the base portion, the brushing portion having a plurality of discrete gutters disposed on the first surface, at least one of the discrete gutters having two opposite open ends located on a perimeter of the first surface, and a sidewall of at least one of the discrete gutters being inclined at an angle relative to the first surface; and a brush holder configured for holding the base portion.

10. The back surface treatment assembly of claim 9, further comprising:

a compression force exerting mechanism configured for exerting a compression force to the brush against the substrate.

11. The back surface treatment assembly of claim 9, further comprising:

at least one rotating mechanism configured for rotating at least one of the carrier head and the brush holder.

12. The back surface treatment assembly of claim 9, further comprising:

a carrier head rotating mechanism configured for rotating the carrier head.

13. The back surface treatment assembly of claim 9, further comprising:

a brush holder rotating mechanism configured for rotating the brush holder.

14. The back surface treatment assembly of claim 9, further comprising:

a carrier head rotating mechanism configured for rotating the carrier head in a first direction; and a brush holder rotating mechanism configured for rotating the brush holder in a second direction opposite to the first direction.

15. The back surface treatment assembly of claim 9, further comprising:

a carrier head rotating mechanism configured for rotating the carrier head about a first axis; and a brush holder rotating mechanism configured for rotating the brush holder about a second axis substantially parallel with the first axis.

16. The back surface treatment assembly of claim 9, wherein the brush holder is movable relative to the carrier head.

17. A back surface treatment (BST) assembly, comprising:

a carrier head configured for holding a substrate;

a brush having a first surface configured for contacting with the substrate, the brush having a plurality of discrete gutters disposed on the first surface, at least one of the discrete gutters having two opposite open ends located on a perimeter of the first surface, and a sidewall of at least one of the discrete gutters being inclined at an angle relative to the first surface; and a brush holder rotating mechanism configured for rotating the brush.

18. The back surface treatment assembly of claim 17, wherein at least one of the discrete gutters has a depth measured from the first surface.

19. The back surface treatment assembly of claim 18, wherein the depth ranges substantially from about 0.01 mm to about 1 mm.

20. The back surface treatment assembly of claim 17, wherein the angle ranges substantially from about 10 degrees to about 90 degrees.

* * * * *